US005141163A

United States Patent [19]

Scheidler

[11] Patent Number: 5,141,163

[45] Date of Patent: Aug. 25, 1992

[54] SHOWER HEAD WITH IMPROVED WATER DISCHARGE

[75] Inventor: Jerome D. Scheidler, Elyria, Ohio

[73] Assignee: Moen Incorporated, Elyria, Ohio

[21] Appl. No.: 689,491

[22] Filed: Apr. 23, 1991

[51] Int. Cl.[5] ..... B05B 1/14

[52] U.S. Cl. ..... 239/558; 239/553; 239/590

[58] Field of Search ..... 239/460, 558, 587, 590, 239/553, 553.5, 590.5; 4/612

[56] References Cited

U.S. PATENT DOCUMENTS

| | | | |
|---|---|---|---|
| 2,049,141 | 7/1936 | Schneider | 239/558 |
| 2,935,265 | 5/1960 | Richter | 239/587 |
| 3,018,969 | 1/1962 | Gentry | 239/460 |
| 3,081,040 | 3/1963 | Hartmann | 239/460 |
| 3,254,842 | 6/1966 | Bachli et al. | 239/460 |
| 3,826,429 | 7/1974 | Moen | 239/460 |
| 3,836,083 | 9/1974 | Bell | 239/460 |
| 4,850,539 | 7/1989 | Gonzalez | 239/558 |

*Primary Examiner*—Andres Kashnikow
*Assistant Examiner*—Christopher G. Trainor
*Attorney, Agent, or Firm*—Kinzer, Plyer, Dorn, McEachran & Jambor

[57] ABSTRACT

A shower head which has a one-piece body with a closed discharge end has a plurality of discharge openings arranged in concentric circles. The openings in the inner circle are generally cylindrical. There is an axial projection at the closed discharge end of the body which extends toward the body interior, with the projection being so sized and positioned that the water velocity profile across each opening in the inner circle is generally uniform, resulting in a water discharge spray pattern with higher velocity and improved trajectory.

4 Claims, 1 Drawing Sheet

SHOWER HEAD WITH IMPROVED WATER DISCHARGE

THE FIELD OF THE INVENTION

The present invention relates to shower heads of the type which may be used in residential, hotel/motel or public shower enclosures. In particular, it relates to a shower head which may be manufactured at less cost than previous designs and which has an improved discharge trajectory.

DESCRIPTION OF THE RELATED ART

U.S. Pat. Nos. 4,275,843, 3,997,116, 3,836,083 and 3,826,429, all owned by the assignee of the present invention, show earlier forms of shower heads with varying spray patterns. Some of the spray patterns are adjustable and others are not. The present invention is specifically directed to a shower head of the general configuration shown in the above-referenced patents, but which has improved water discharge velocity and trajectory and which may be manufactured at substantially less cost than the devices of the prior art.

SUMMARY OF THE INVENTION

The present invention is specifically directed to a shower head which has improved discharge velocity and trajectory.

A primary purpose of the invention is to provide a shower head for the use described which has an improved discharge trajectory and which may be manufactured at substantially less cost than prior art shower heads.

Another purpose is a shower head of the type described having multiple discharge openings which are arranged in concentric circles, with the inner circle of openings forming a generally cylindrical discharge pattern and the outer circle of openings forming a generally diverging spray pattern.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
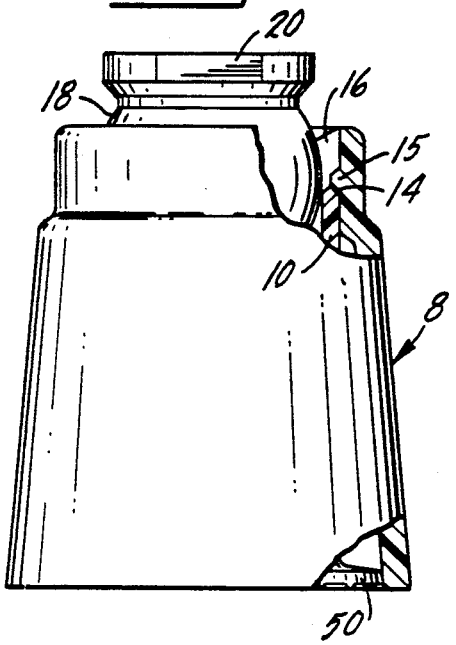
FIG. 1 is a side view of the shower head disclosed herein with portions broken away.

The shower head disclosed herein includes a generally cylindrical, somewhat tapered outer shell 8, surrounding a hollow body 10 with a closed discharge end 12. The open end of body 10 has a peripheral exterior groove 14 which mates with an interior projection 15 on the inside of shell 8. There are a plurality of axially extending circumferentially spaced slots 16 on the open end of body 10 which provide a degree of flexibility so that the body may interconnect with a swivel member 18. The swivel, which is a conventional mounting means for shower heads, has an exterior tool engaging surface 20 and an interior passage which opens into the interior of the hollow body 10.

The mounting of body 10 to the swivel 18 includes a seal ring 24 urged against the swivel by a retainer 26 biased by a coil spring 28. Spring 28 maintains seal 24 in sealing contact with swivel 18 and the interior of body 10 and also functions to relatively position the swivel and the open end of body 10. Spring 28 may be bottomed or seated on a plurality of axially extending projections 30 which are integral with the interior of the body.

Figure 4:
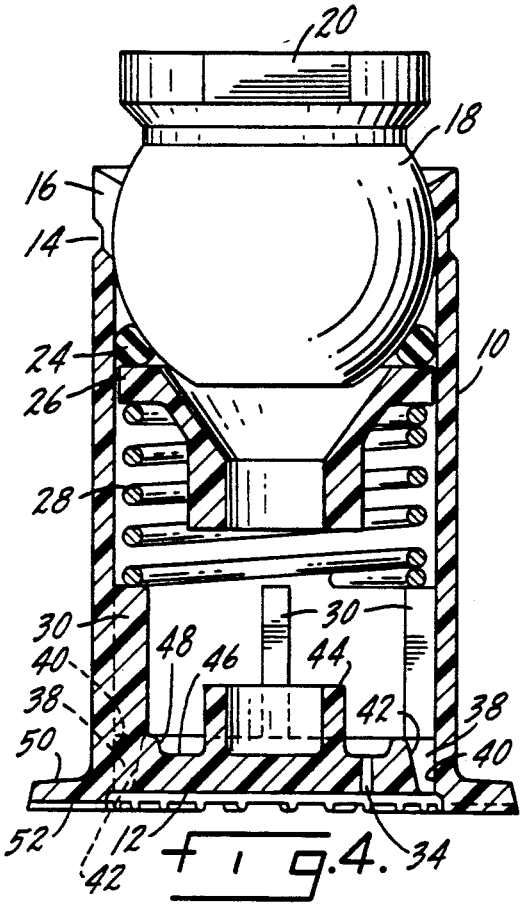
FIG. 4 is a section along plane 4—4 of FIG. 3.
Figure 2:
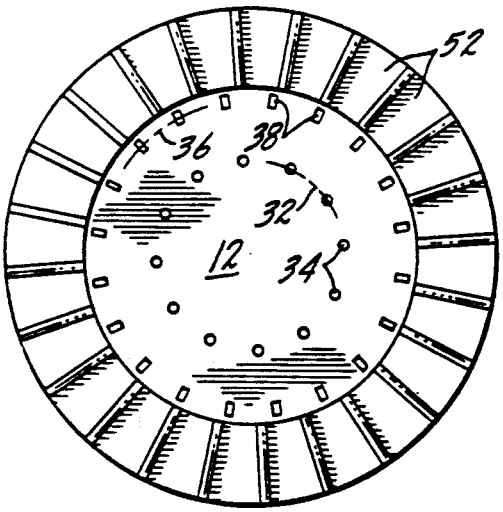
FIG. 2 is a bottom view of the shower head body of FIG. 1.
Figure 3:
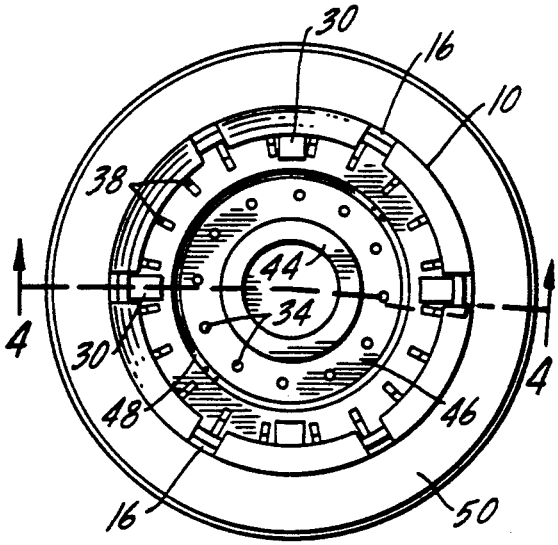
FIG. 3 is a top view of the shower head body, with the attaching elements removed for clarity.

Focusing particularly on FIGS. 2 and 3, there are a plurality of discharge openings arranged along a pair of concentric circles. The inner circle 32 includes a plurality of circular openings 34 and the outer circle 36 includes a plurality of openings 38 having a generally rectangular cross section. As particularly shown in FIG. 4, each of the rectangular cross section openings 38 has an outer wall 40 extending in an axial direction and an inner wall 42 which has a diverging taper, with the result that the spray pattern from the holes in the outer circle will gradually diverge in a direction away from the discharge end of the shower head.

It is highly desirable to have the inner circular holes provide a cylindrical discharge pattern, one that neither diverges nor converges. However, it is known that the velocity profile across a tube without obstructions will show a generally zero velocity at the periphery and a maximum velocity at the center of the tube. This can result in a differential velocity profile across the openings in the inner circle which tends to make the spray from these openings converge. To eliminate such convergence there is an axial projection 44 on the interior side of the discharge end 12 of body 10. Projection 44 may be in the form of a hollow boss, or it may be solid.

There is an annular trough 46 formed between the outer wall of projection 44 and an inwardly-extending projection 48, which is annular in form and extends from the discharge end of the body. Each of the circular openings 34 on the inner circle 32 open into trough 46 at a location generally equidistant from the outer wall of projection 44 and projection 48. By so locating the discharge openings in the inner circle, the velocity profile across each of the openings in this array will be generally uniform across the cross section of the opening. This results in a spray pattern from the generally cylindrical openings 34 which is cylindrical in form and neither converges nor diverges. It also provides a discharge in which the water velocity at the outlet side of the discharge openings is increased over that in prior shower heads, resulting in an improved trajectory.

It should be understood that although the openings 34 are shown as being cylindrical, there may be a slight taper, on the order of one degree, for ease in removing the mold core pins when the mold for manufacturing the shower head is parted.

Preferably, the shower head body is formed of a suitable plastic, which reduces the cost of the device over prior metallic shower heads. Also, prior art shower heads of the type shown in the above-referenced patents usually have a body formed of more than one part. The present invention reduces the cost of the shower heads by having the body formed of a single element. The shower head body is completed by an outwardly-extending annular flange 50 which may have a plurality of radially extending grooves 52 which are essentially for decorative purposes.

Whereas the preferred form of the invention has been shown and described herein, it should be realized that there may be many modifications, substitutions and alterations thereto.

The embodiments of the invention in which an exclusive property or privilege is claimed are defined as follows:

1. A shower head including a hollow body, means attached to said body at one end thereof for use in mounting the shower head to a plumbing fitting, said body having a closed discharge end with a plurality of discharge openings arranged along a plurality of concentric circles, said plurality of concentric circles comprising an inner circle of said openings and an outer circle of said openings, said body closed discharge end having a centrally located generally cylindrical boss extending toward the body interior, said boss being coaxial with the longitudinal axis of the body, an annular wall integral with said body closed end and extending toward said body interior, an interior annular trough formed in the interior of said body discharge end between the exterior of said generally cylindrical boss and the interior of said annular wall, each of said openings in the inner circle being centrally located in said trough midway between the exterior of said generally cylindrical boss and the interior of said annular wall whereby the water velocity profile across each of said openings in the inner circle is generally uniform, resulting in a water discharge spray pattern from said inner circle of openings that is generally parallel to the axis of said body, and wherein the openings in the outer circle are formed between the exterior of said annular wall and an interior wall of said body, the exterior of said annular wall being tapered which causes a discharge spray pattern from the outer circle of said openings to diverge as the water leaves the shower head.

2. The shower head of claim 1 further characterized in that the interior wall of said body defining the openings in the outer circle is generally parallel to the longitudinal axis of the body.

3. The shower head of claim 2 further characterized in that each of the openings along said outer circle have a generally rectangular cross section.

4. The shower head of claim 1 further characterized in that each of the openings along said inner circle are generally cylindrical and have an axis generally parallel to the longitudinal axis of the hollow body.

* * * * *